US011401809B2

(12) United States Patent
Zadel

(10) Patent No.: US 11,401,809 B2
(45) Date of Patent: Aug. 2, 2022

(54) GRAVEL EXCAVATION SYSTEM

(71) Applicant: Northern Colorado Constructors, Inc., Lupton, CO (US)

(72) Inventor: Christopher J. Zadel, Longmont, CO (US)

(73) Assignee: Northern Colorado Constructors, Inc., Fort Lupton, CO (US)

( * ) Notice: Subject to any disclaimer, the term of this patent is extended or adjusted under 35 U.S.C. 154(b) by 0 days.

(21) Appl. No.: 17/226,782

(22) Filed: Apr. 9, 2021

(65) Prior Publication Data

US 2021/0317740 A1 Oct. 14, 2021

Related U.S. Application Data

(60) Provisional application No. 63/007,688, filed on Apr. 9, 2020.

(51) Int. Cl.

| | |
|---|---|
| ***E21C 41/16*** | (2006.01) |
| *E21C 31/04* | (2006.01) |
| *E21C 29/22* | (2006.01) |

(52) U.S. Cl.

CPC ..... *E21C 41/16* (2013.01); *E21C 29/22* (2013.01); *E21C 31/04* (2013.01)

(58) Field of Classification Search

CPC ..... B65G 33/14–22; B65G 2201/045; E21C 41/16; E21C 29/22; E02F 3/06

See application file for complete search history.

(56) References Cited

U.S. PATENT DOCUMENTS

| | | | | |
|---|---|---|---|---|
| 1,701,678 A * | 2/1929 | Jaeger | E02F 3/06 | 37/189 |
| 2,287,944 A * | 6/1942 | Peterman | B65D 90/64 | 198/530 |
| 2,810,566 A * | 10/1957 | Parsons | E21C 25/58 | 175/391 |
| 6,343,663 B1 * | 2/2002 | Hill | E21B 7/005 | 175/162 |
| 2010/0282780 A1 * | 11/2010 | Babiarz | B65B 1/12 | 222/196 |

FOREIGN PATENT DOCUMENTS

WO WO-2021207658 A1 * 10/2021 ..... E21C 27/22

* cited by examiner

*Primary Examiner* — Janine M Kreck
(74) *Attorney, Agent, or Firm* — Samuel M. Freund; Cochran Freund & Young LLC

(57) ABSTRACT

A system and method are described for excavation of gravel from a gravel formation including an elongated cylindrical casing surrounding and supporting a rotating auger extending a chosen distance beyond an open end of the casing, and having openings through its upper surface for permitting gravel to enter the casing in addition to entering through the open end thereof, a source of vibration for vibrating the casing, a conveyor for removing material excavated by the system through an opening in the bottom surface of the casing, and a tracked excavator or other suitable vehicle for preventing the casing from rotating and for pushing the casing in a chosen horizontal direction into the gravel formation.

20 Claims, 5 Drawing Sheets

GRAVEL EXCAVATION SYSTEM

CROSS-REFERENCE TO RELATED APPLICATIONS

The present application claims the benefit of U.S. Provisional Patent Application No. 63/007,688 for "Gravel Excavation System" which was filed on Apr. 9, 2020, the entire content of which is hereby specifically incorporated by reference herein for all that it discloses and teaches.

BACKGROUND

Gravel is formed of rocks that are unconnected to each other, typically between 0.25 and 2.5 in. in diameter (pea or pebble gravel), and is found naturally. Cobble gravel may obtain particle sizes between 2.5 in. and 10.1 in. Deposits of sand and gravel are generally near the surface of the Earth, and are suitable for open pit mining performed with power shovels, front-end loaders and conveyors.

Sand and gravel deposits are accumulations of durable rock fragments and mineral particles, which result from the disintegration of bedrock and subsequent transport, abrasion, and deposition of the weathered fragments. Ice and water are the principal geologic agents that affect the distribution of deposits of sand and gravel.

The largest single use of natural aggregates (sand and gravel) is in construction, and much of that aggregate is used in Portland-cement concrete.

SUMMARY

In accordance with the purposes of the present invention, as embodied and broadly described herein, an embodiment of the gravel excavation system of the present invention hereof, includes: an elongated cylindrical steel pipe casing having a chosen inner diameter, and a chosen length, a first open end and a second open end, an outer surface, at least one first rectangular-shaped opening on the top portion of the outer surface near to the second open end, and at least one second rectangular-shaped opening on the bottom surface of the outer surface near to the first open end; an auger having a chosen diameter, pitch, and length, and a driving spindle at one end thereof that passes through the first open end of the cylindrical casing; a hollow cylindrical housing attached to the cylindrical casing having a closed end and an open end in communication with the first end of the elongated cylindrical casing such that the driving spindle of the auger passes through the open end of the housing; a motor disposed within the cylindrical housing for turning the driving spindle of the auger at a chosen speed; and a vehicle for pushing the cylindrical casing into a gravel formation.

In another embodiment of the present invention, and in accordance with its purposes as broadly described herein, the gravel excavation system hereof, includes: a hollow, elongated cylindrical casing having a chosen inner diameter, and a chosen length, a first open end and a second open end, an outer surface, at least one first rectangular-shaped opening on the top portion of the outer surface near to the second open end, and at least one second rectangular-shaped opening on the bottom surface of the outer surface near to the first open end; an auger having a chosen diameter, pitch, and length, and a driving spindle at one end thereof that passes through the first open end of the elongated cylindrical casing, and adapted to rotate within the elongated cylindrical casing; a hollow cylindrical housing attached to the elongated cylindrical casing having a closed end and an open end in communication with the first open end of the elongated cylindrical casing such that the driving spindle of the auger passes through the open end of the hollow cylindrical housing; a motor disposed within the hollow cylindrical housing for turning the driving spindle of the auger at a chosen speed; a source of vibration disposed on the outer surface of the elongated cylindrical casing near to the first open end thereof, effective for vibrating the elongated cylindrical casing at a chosen frequency and a chosen amplitude; and a first vehicle for pushing the elongated cylindrical casing into a gravel formation.

In yet another embodiment of the present invention, and in accordance with its purposes as broadly described herein the method for extracting gravel from a gravel formation hereof, includes: moving a hollow, elongated cylindrical casing having a first end, a second open end, and an outer surface, at least one first rectangular-shaped opening on the top portion of the outer surface near to the second end, and at least one second rectangular-shaped opening on the bottom surface of the outer surface near to the first end, into said gravel formation; rotating an auger having a chosen diameter, pitch, and length, adapted to rotate within the elongated cylindrical casing at a selected speed; vibrating the elongated cylindrical casing at a chosen frequency and a chosen amplitude; whereby gravel from the gravel formation enters the elongated cylindrical casing through the second end and the at least one first rectangular-shaped opening; and extracting the gravel through the at least one second rectangular-shaped opening.

Benefits and advantages of the present invention include, but are not limited to, providing a gravel excavation system for efficiently removing gravel from a gravel formation without requiring heavy soil-moving equipment for digging into the formation using shovels.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Briefly, embodiments of the present system for gravel excavation from a gravel formation, include an elongated cylindrical casing surrounding and supporting an auger, and having openings at the front end thereof, and on its upper surface for permitting gravel to enter the casing. The auger extends through the front open end of the casing and is rotated by a motor disposed in a housing attached to the casing at the opposite end of the casing from the open end thereof. A source of vibration is provided for vibrating the casing, thereby assisting in moving the gravel above the casing into the openings. The gravel entering the openings and through the open end of the casing is moved by the rotating auger to an opening in the bottom surface of the casing near the other end thereof, where the gravel drops onto a conveyor. A tracked excavator or other vehicle is provided for preventing the casing from rotating and for pushing the casing in a chosen horizontal direction into a gravel formation.

Formations for which the present system would perform best may be characterized by the term sandy gravely material, where sandy means sand to pea-sized gravel material, and gravely means pea-sized gravel up to 4"-6" cobble. The rotating auger would experience difficulty in moving rocks larger than cobble size entering the openings in the top of the elongated casing through to the conveyor. Interestingly, gravel formations generally do not contain large rocks, since they comprise round river rock. However, the nature of the target gravel formation may be investigated by advance testing by boring or coring the formation.

Figure 1:
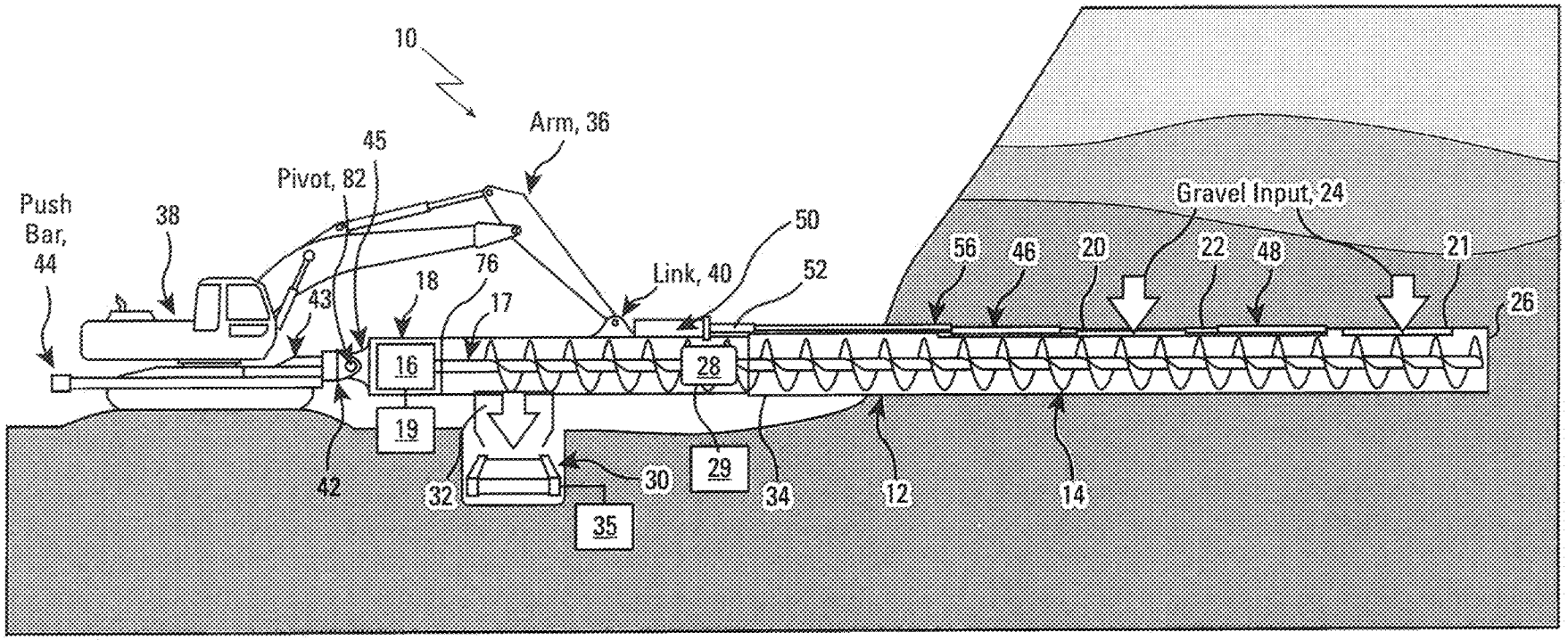
FIG. 1 is a is a schematic representation of a side view of an embodiment of the gravel excavation system of the present invention, showing an elongated cylindrical casing surrounding an auger rotated by a driving motor disposed in a housing attached to the casing, and having openings on its upper surface for permitting gravel to enter the casing from other locations in addition to the forward opening thereof, a vibrating apparatus for vibrating the casing, a conveyor for removing material excavated by the system through an opening in the bottom surface of the casing, and a tracked excavator for preventing the cylindrical casing from rotating and for pushing the casing in a chosen horizontal direction into a gravel formation.

Reference will now be made in detail to the present embodiments of the invention, examples of which are illustrated in the accompanying drawings. In the FIGURES, similar structure will be identified using identical reference characters. It will be understood that the FIGURES are presented for the purpose of describing particular embodiments of the invention and are not intended to limit the invention thereto. Turning now to FIG. 1, illustrated is a schematic representation of a side view of an embodiment of the gravel excavation system, 10, of the present invention, showing elongated cylindrical casing, 12, (between about 36 in. and about 60 in. i.d.) surrounding and supporting auger, 14, having a chosen diameter (between about 30 in. and about 54 in. i.d.) and a selected pitch (between about 12 in. and about 24 in.), rotated by auger motor, 16, using attached rod, 17, (between about 2 rpm and about 35 rpm) and disposed in housing 18. Housing 18 may be attached to cylindrical casing 12 by flanges at the end of housing 18 and cylindrical casing 12, not shown in Hal. Auger 14 may protrude a chosen distance (about 20 in. as an example) out of the forward opening (26) of casing 12; however, significant protrusion may not be required. Cylindrical casing 12 may be constructed from 20-foot lengths of steel pipe welded together such that as much as about 500 feet of casing may be inserted into the gravel formation. Auger motor 16 may be powered by a hydraulic system, 19, or by gas or electricity, depending on the availability of these power sources.

Openings, 20, and 21, on upper surface, 22, of casing 12 permit gravel, 24, to enter the elongated casing by action of gravity from other locations than forward opening, 26, thereof. It is anticipated that effective dimensions for openings 20 and 21 would be between 1 foot and 3 feet wide by five feet long for use in gravel formations. However, other opening sizes may be employed because embodiments of the present apparatus will find use in material transport other than gravel and sand. The first opening may be located at least 5 feet from the end of the casing, since closer locations might affect the structural integrity of casing 12, as it is directed into material formations. A single opening or more than two openings 20 and 21, are possible depending on the nature of the gravel formation.

A source of vibration, 28, is provided for vibrating casing 12 to assist gravity in moving the gravel into voids created by auger 14, and in moving the gravel through the casing. Vibrator 28 may be installed on the outside surface of elongated casing 12 toward the rearward end thereof; that is, at a location that is not inserted into the gravel formation. Vibrator 28 may be driven, 29, by a hydraulic system or by gas or electricity, depending on the availability of these power sources.

Conveyor, 30, removes gravel excavated by system 10 through opening, 32, in the bottom surface, 34, of casing 12 to a chosen location. Initially, material being discharged through opening 32 as casing 12 is inserted into the gravel formation is moved away from the casing with another piece of equipment (not shown in FIG. 1). Once casing 12 is inserted a sufficient distance into the gravel formation such that there is a significant quantity of gravel above openings 20 and 21 of the casing, conveyor 30 will be moved into position to remove the discharged material. Conveyor 30 may be driven, 35, by a hydraulic system or by gas or electricity, depending on the availability of these power sources.

Arm, 36, of tracked excavator, 38, or other suitable vehicle, prevents casing 12 from rotating using link, 40, which is rigidly attached to top surface 22 of casing 12, and horizontally pivoting hinged member, 42, attached to housing 18 with rearward leaf, 43, thereof also attached to excavator 38. Excavator 38 and hinged member 42 function together to also advance elongated casing 12 in a chosen horizontal direction into a gravel formation by means of push bar, 44, attached to rearward leaf, 43, of hinged member 42, with forward leaf, 45, of hinged member 42 being attached to the rearward end of housing 18. Push bar 44, also attached to excavator 38, may be utilized for pushing casing 12 into the formation when a second vehicle is employed.

Clearly, other powered earth moving equipment can be used in place of the tracked excavator, for providing similar functionality. Additionally, as mentioned above, there can be fewer (one) or greater than two openings 20 and 21 in upper surface 22 of casing 12 for admitting gravel. Moreover, there may be more than one opening 32 in bottom surface 34 of casing 12 for permitting to exit casing 12 under the action of auger 14 and vibrator 28.

Figure 2:
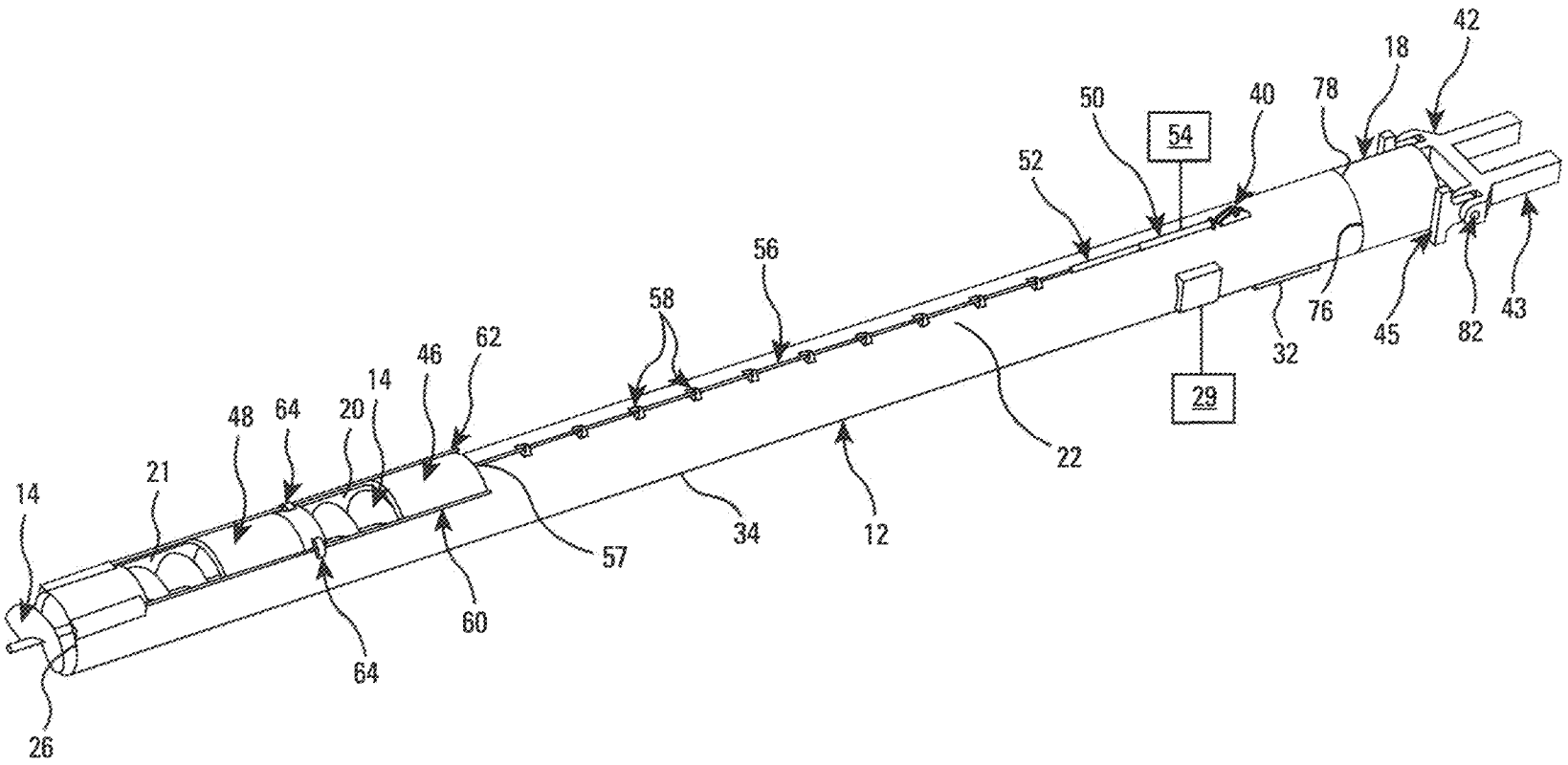
FIG. 2 is a schematic representation of a top perspective view of the embodiment of the elongated cylindrical casing shown in FIG. 1, illustrating the openings on the upper surface thereof, doors for adjusting the size of the openings, the forward end of the casing where the auger is disposed a chosen distance outside of the forward end, the hinged cylindrical master casing or housing containing the driving motor for the auger at the rearward end of the cylindrical casing, and the link member, also disposed on the top surface thereof, for attachment to the arm of the excavator.

FIG. 2 is a schematic representation of a top perspective view of elongated cylindrical casing 12 shown in FIG. 1, illustrating openings 20 and 21 on upper surface 22 thereof, the forward end of casing 12 where auger 14 is shown disposed a chosen distance outside of the forward end 26 thereof, hinged member 42 at the rearward end of component housing 18, and link member 40, also disposed on the upper surface 22 thereof. Slidable doors, 46, and 48, are shown for accurately controlling the flow of material entering openings 20 and 21 in casing 12, respectively. Door motor, 50, drives piston, 52, that moves rod, 56, attached, 57, to door 46. Rod 56 is guided by pillow block bearings, 58, mounted on top surface 22 of casing 12. Door motor 50 may be powered, 54, by a hydraulic system or by gas or electricity, depending on the availability of these power sources. It is anticipated that the hydraulic system of tracked excavator 38 will be used to provide hydraulic power to auger motor 16, vibrator 28, conveyor 30, and to door motor 50. Door 46 is connected to door 48 and moved thereby as will be described in FIG. 4 below, which permits doors 46 and 48 to be operated externally from the gravel reservoir.

Figure 3:
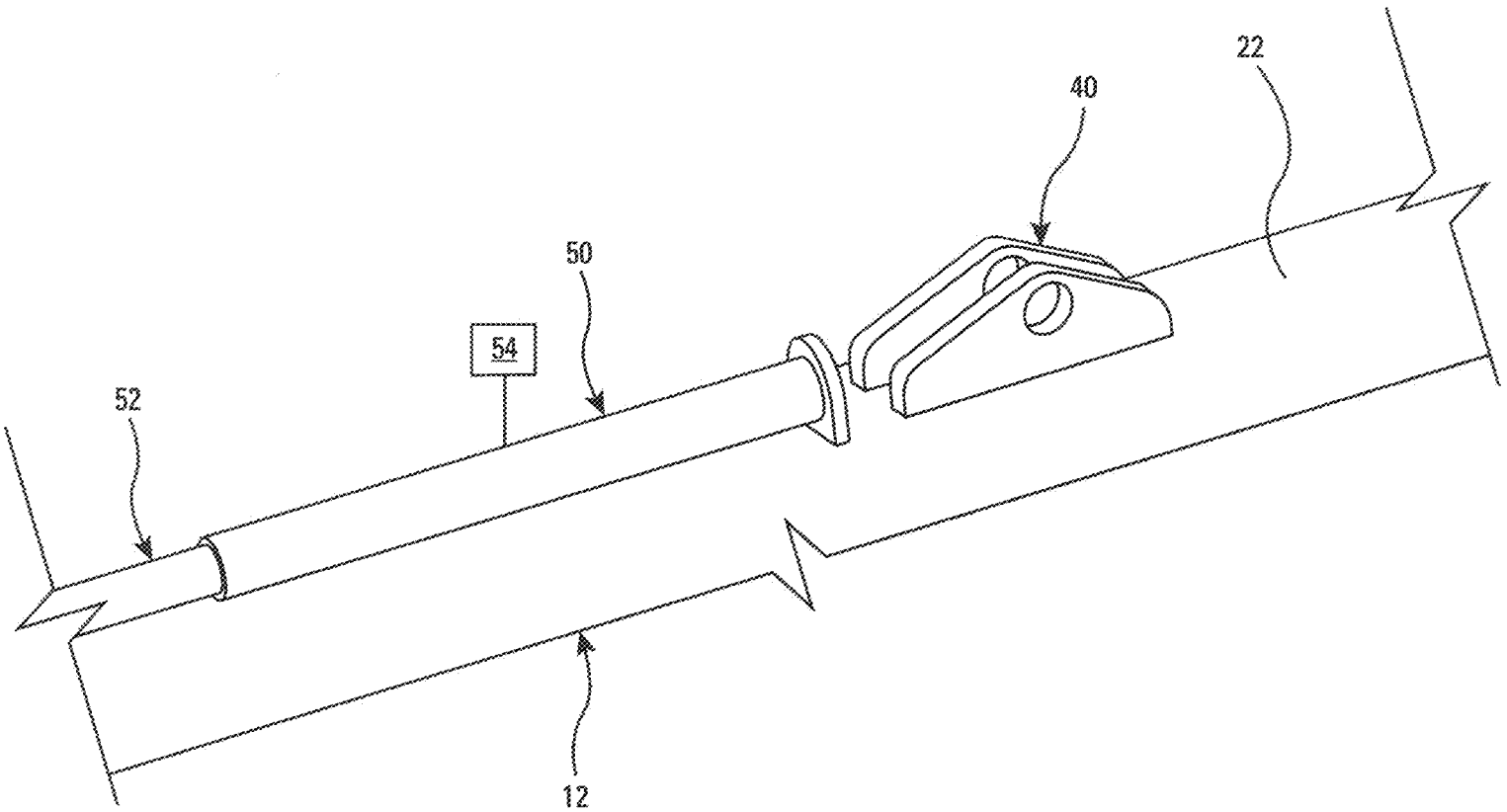
FIG. 3 is a schematic representation of an expanded top perspective view of the embodiment of a rearward portion of the elongated cylindrical casing illustrated in FIG. 2, showing the link member and a motor for operating the doors for adjusting the size of the openings on the top surface of the elongated casing.

FIG. 3 is a schematic representation of an expanded top perspective view of the embodiment of the rearward portion of the elongated cylindrical casing illustrated in FIG. 2, showing link member 40, door motor 50 and piston 52 for operating doors 46 and 48 (shown in FIG. 2 and in FIG. 4, below) for adjusting the size of the openings 20 and 21 (shown in FIG. 2 and in FIG. 4, below), respectively, on top surface 22 of elongated casing 12.

Figure 4:
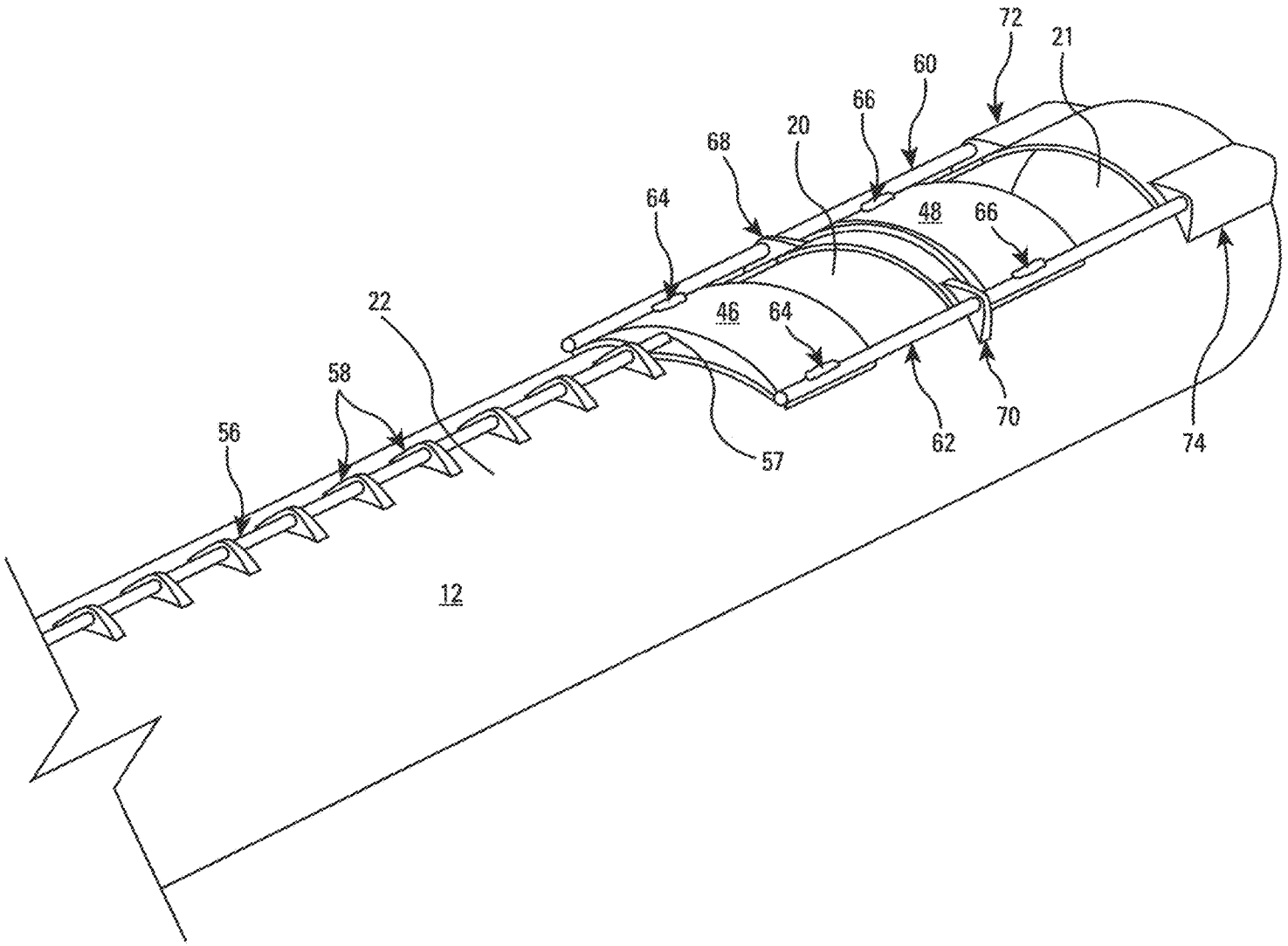
FIG. 4 is a schematic representation of a top perspective view of an embodiment of a front portion of the elongated cylindrical casing, showing the openings in the top surface of the casing and the doors for adjusting the size thereof.

FIG. 4 is a schematic representation of a top perspective view of an embodiment of a front portion of elongated cylindrical casing 12, showing openings 20 and 21 in top surface 22 of casing and doors 46 and 48 for adjusting the size thereof. As stated above, rod 56 is attached, 57, to door 46, for example, by welding, and driven by door motor 50 and piston 52, shown in FIG. 2, above. Door 48 is connected to door 46 and moved thereby, which permits doors 46 and 48 to be operated externally from the gravel reservoir.

Rods, 60, and, 62, are shown attached to doors 46 and 48 by welds, 64, and, 66, and guided by pillow block bearings, 68, and, 70, mounted on top outer surface 22 of elongated casing 12, respectively. Rods 60 and 62 are further slidably captured by blocks, 72, and, 74, adapted to slidably receive rods 60 and 62, respectively, and also mounted on top outer surface 22 of elongated casing 12. Clearly, pillow block bearings 58, 68, and 70, and blocks 72 and 74 can be attached to elongated casing 12 by other means, as can rods 60 and 62 be attached to doors 46 and 48, respectively, and rod 56 to door 46.

Figure 5:
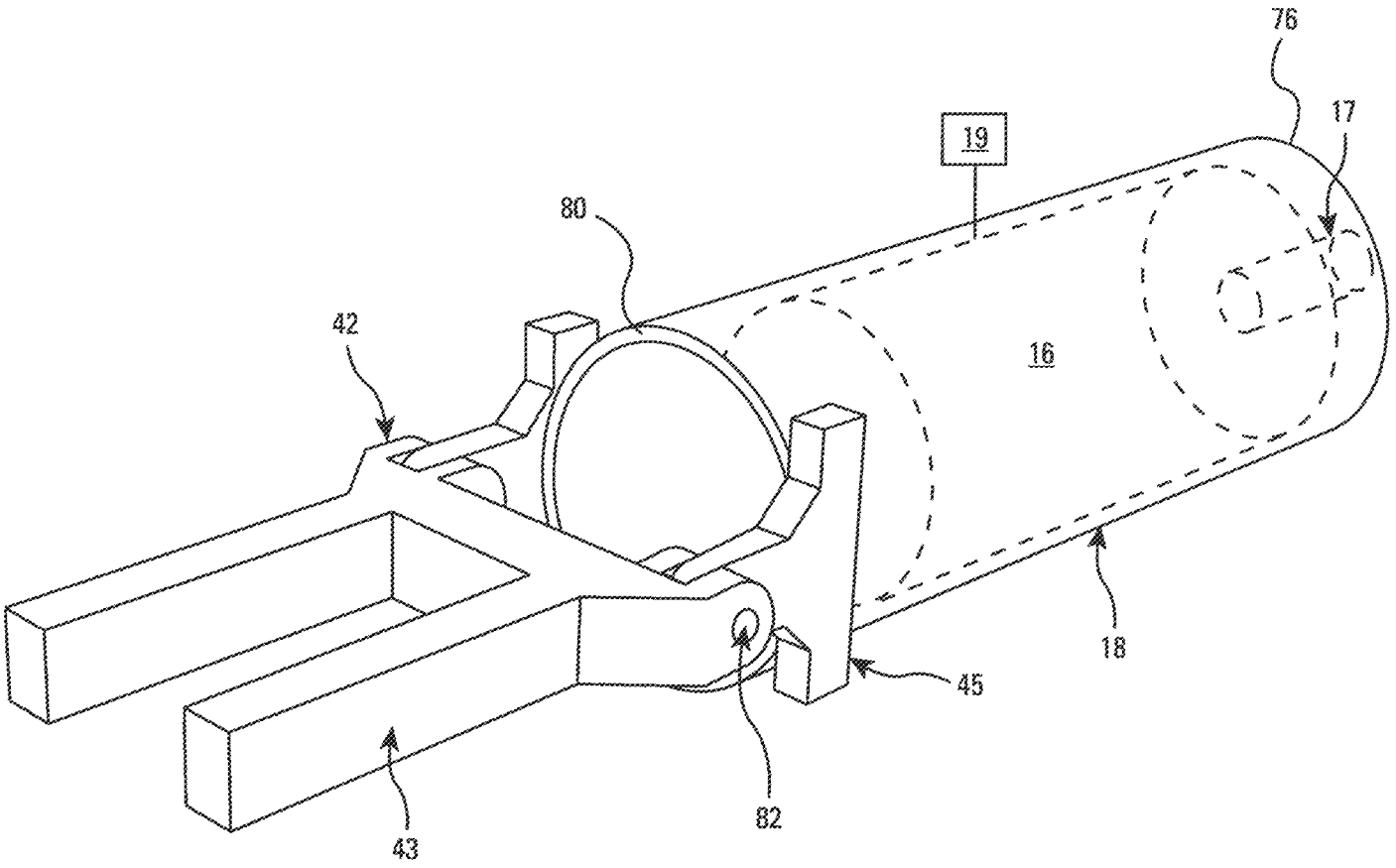
FIG. 5 is a schematic representation of a top perspective view of an embodiment of the hinged cylindrical master casing adapted for enclosing a motor effective for rotating the auger, the housing being attachable at its forward end to the rearward open end of the elongated cylindrical casing, and attached at its rearward end to a hinged member having a horizontal axis of rotation, which is attachable to a vehicle for driving the gravel excavation apparatus into a gravel formation.

FIG. 5 is a schematic representation of an expanded top perspective view of cylindrical housing 18 adapted for enclosing motor 16 effective for rotating the auger (not shown in FIG. 5) by means of rod 17 and powered by power source 19. Housing 18 is attachable at forward end, 76, to rearward open end, 78, of elongated cylindrical casing 12, and attached near rearward end, 80, to forward leaf 45 of hinged member 42, and having pivot or knuckle, 82, for providing a horizontal axis of rotation, and pivoting rearward leaf, 43, which is attachable to vehicle 38 for driving the apparatus into a gravel formation (not shown in FIG. 5).

In use, gravel and sand 24 from a formation enters gravel excavation system 10 through openings 20 and 21 in top surface 22 of elongated cylindrical casing 12, and through forward end 26 thereof under the action of the rotating auger 14, and source of vibration 28, which assists in moving the gravel, as tracked excavator, 38, or other suitable vehicle pushes elongated cylindrical casing 12 horizontally into the gravel formation. Once inside elongated casing 12 the gravel and sand are transported, also by the action of the rotating auger, to opening 32 in bottom surface 34 of elongated casing 12, which feeds conveyor 30 for removal.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A gravel excavation system, comprising: a hollow, elongated cylindrical casing having a chosen inner diameter, and a chosen length, a first open end and a second open end, an outer surface, at least one first rectangular-shaped opening on the top portion of the outer surface near to the second open end, and at least one second rectangular-shaped opening on the bottom surface of the outer surface near to the first open end; an auger having a chosen diameter, pitch, and length, and a driving spindle at one end thereof that passes through the first open end of said elongated cylindrical casing, and adapted to rotate within said elongated cylindrical casing; a hollow cylindrical housing attached to said elongated cylindrical casing having a closed end and an open end in communication with the first open end of said elongated cylindrical casing such that the driving spindle of said auger passes through the open end of said hollow cylindrical housing; a motor disposed within said hollow cylindrical housing for turning the driving spindle of said auger at a chosen speed; and a first vehicle for pushing said elongated cylindrical casing into a gravel formation.

2. The apparatus of claim 1, further comprising a first door adapted to slide over at least a portion of the at least one first rectangular-shaped opening.

3. The apparatus of claim 2, further comprising a piston disposed on the surface of said elongated cylindrical casing near to the first end thereof effective for sliding said first door over at least a portion of the at least one first rectangular-shaped opening.

4. The apparatus of claim 1, further comprising a conveyor disposed below the at least one second rectangular-shaped opening.

5. The apparatus of claim 1, further comprising a source of vibration disposed on the outer surface of said elongated cylindrical casing near to the first open end thereof, effective for vibrating the cylindrical casing at a chosen frequency and a chosen amplitude.

6. The apparatus of claim 1, wherein said auger extends a chosen distance beyond the second open end of said elongated cylindrical casing.

7. The apparatus of claim 1, wherein said first vehicle comprises a tracked excavator having a forward end with an arm extending from the forward end, and a rearward end.

8. The apparatus of claim 7, further comprising a link member attached to the top portion of the outer surface of said elongated cylindrical casing near the first end thereof and adapted to be attached to the arm of said tracked excavator, for preventing said elongated cylindrical casing from rotating.

9. The apparatus of claim 7, further comprising a hinge member having a horizontal axis of rotation, a forward leaf and a rearward leaf, said forward leaf being attached to the closed end of said hollow cylindrical housing, and said rearward leaf being attached to the forward end of said tracked excavator.

10. The apparatus of claim 7, further comprising a second vehicle push bar attached to the rearward end of said tracked excavator, and adapted for enabling a second vehicle to assist said first vehicle to move said elongated cylindrical casing in a chosen horizontal direction.

11. A gravel excavation system, comprising: a hollow, elongated cylindrical casing having a chosen inner diameter, and a chosen length, a first open end and a second open end, an outer surface, at least one first rectangular-shaped opening on the top portion of the outer surface near to the second open end, and at least one second rectangular-shaped opening on the bottom surface of the outer surface near to the first open end; an auger having a chosen diameter, pitch, and length, and a driving spindle at one end thereof that passes through the first open end of said elongated cylindrical casing, and adapted to rotate within said elongated cylindrical casing; a hollow cylindrical housing attached to said elongated cylindrical casing having a closed end and an open end in communication with the first open end of said elongated cylindrical casing such that the driving spindle of said auger passes through the open end of said hollow cylindrical housing; a motor disposed within said hollow cylindrical housing for turning the driving spindle of said auger at a chosen speed; a source of vibration disposed on the outer surface of said elongated cylindrical casing near to the first open end thereof, effective for vibrating said elongated cylindrical casing at a chosen frequency and a chosen amplitude; and a first vehicle for pushing said elongated cylindrical casing into a gravel formation.

12. The apparatus of claim 11, further comprising a first door adapted to slide over at least a portion of the at least one first rectangular-shaped opening.

13. The apparatus of claim 12, further comprising a piston disposed on the surface of said elongated cylindrical casing near to the first end thereof effective for sliding said first door over at least a portion of the at least one first rectangular-shaped opening.

14. The apparatus of claim 11, further comprising a conveyor disposed below the at least one second rectangular-shaped opening.

15. The apparatus of claim 11, wherein said auger extends a chosen distance beyond the second open end of said elongated cylindrical casing.

16. The apparatus of claim 11, wherein said first vehicle comprises a tracked excavator having a forward end with an arm extending from the forward end, and a rearward end.

17. The apparatus of claim 16, further comprising a hinge member having a horizontal axis of rotation, a forward leaf and a rearward leaf, said forward leaf being attached to the closed end of said hollow cylindrical housing, and said rearward leaf being attached to the forward end of said tracked excavator.

18. The apparatus of claim 16, further comprising a link member attached to the top portion of the outer surface of said elongated cylindrical casing adapted to be attached to the arm of said tracked excavator, for preventing said elongated cylindrical casing from rotating.

19. The apparatus of claim 16, further comprising a second vehicle push bar attached to the rearward end of said tracked excavator, and adapted for enabling a second vehicle to assist said first vehicle to move said elongated cylindrical casing in a chosen horizontal direction.

20. A method for extracting gravel from a gravel formation, comprising:

moving a hollow, elongated cylindrical casing having a first end, a second open end and an outer surface, at least one first rectangular-shaped opening on the top portion of the outer surface near to the second end, and at least one second rectangular-shaped opening on the bottom surface of the outer surface near to the first open end, into said gravel formation;

rotating an auger having a chosen diameter, pitch, and length, adapted to rotate within the elongated cylindrical casing at a selected speed;

vibrating the elongated cylindrical casing at a chosen frequency and a chosen amplitude;

whereby gravel from said gravel formation enters the elongated cylindrical casing through the second open end and the at least one first rectangular-shaped opening; and extracting said gravel through the at least one second rectangular-shaped opening.

* * * * *